United States Patent [19]

Norton et al.

[11] 4,452,028

[45] Jun. 5, 1984

[54] STRUCTURE AND METHOD FOR REINFORCING A WALL

[75] Inventors: Willard S. Norton, 5608 NE. Oaktree La., Kansas City, Mo. 64118; Robert G. Samuelson, Kansas City, Kans.

[73] Assignee: Willard S. Norton, Kansas City, Mo.

[21] Appl. No.: 327,262

[22] Filed: Dec. 3, 1981

Related U.S. Application Data

[63] Continuation-in-part of Ser. No. 188,936, Sep. 19, 1980, Pat. No. 4,353,194.

[51] Int. Cl.[3] ..... E04B 1/04; E04G 23/02; E02D 37/00

[52] U.S. Cl. ..... 52/744; 52/514; 52/743; 52/295; 52/300

[58] Field of Search ..... 52/295, 169.6, 300, 52/743, 744, 514, 439, 293, 294, 741, 303, 127.1, 442, 125.2, 100, 98

[56] References Cited

U.S. PATENT DOCUMENTS

| | | | |
|---|---|---|---|
| 1,783,383 | 12/1930 | Montrief | 52/100 |
| 2,737,801 | 3/1956 | Barnhart | 52/100 |
| 2,881,613 | 4/1959 | Taylor et al. | 52/442 |
| 3,292,331 | 12/1966 | Sams | 52/300 |
| 3,537,220 | 11/1970 | Ellis | 52/293 |
| 3,788,017 | 1/1974 | Bachus | 52/125.2 |
| 3,855,752 | 12/1974 | Aylon | 52/439 |
| 4,024,688 | 5/1977 | Calini | 52/741 |
| 4,154,030 | 5/1979 | Huguet | 52/300 |

FOREIGN PATENT DOCUMENTS

| | | | |
|---|---|---|---|
| 1093587 | 10/1954 | France | 52/100 |
| 1106436 | 11/1955 | France | 52/98 |
| 502106 | 12/1976 | U.S.S.R. | 52/295 |

*Primary Examiner*—John E. Murtagh
*Assistant Examiner*—Michael Safavi
*Attorney, Agent, or Firm*—Litman, Day & McMahon

[57] ABSTRACT

A structure and method for reinforcing a wall including a plurality of blocks having vertically aligned passages and a sill plate positioned on top of the blocks. An opening is formed into one of the passages and lower and intermediate reinforcing bars are inserted through the opening and into the vertically aligned passages. An aperture is formed in the sill plate above the vertically aligned passages and an upper reinforcing bar is extended through the aperture and positioned partly within the vertically aligned passages, wherein it is connected to the lower and intermediate reinforcing bars, thereby forming an elongate reinforcing member. A cementous material which cures to a hardened state is placed in the vertically aligned passages whereby the elongate reinforcing member is fixedly attached to the wall therein. An upper portion of the upper reinforcing bar is threaded and adapted to threadably receive a nut which engages the sill plate.

9 Claims, 3 Drawing Figures

Fig. 1.
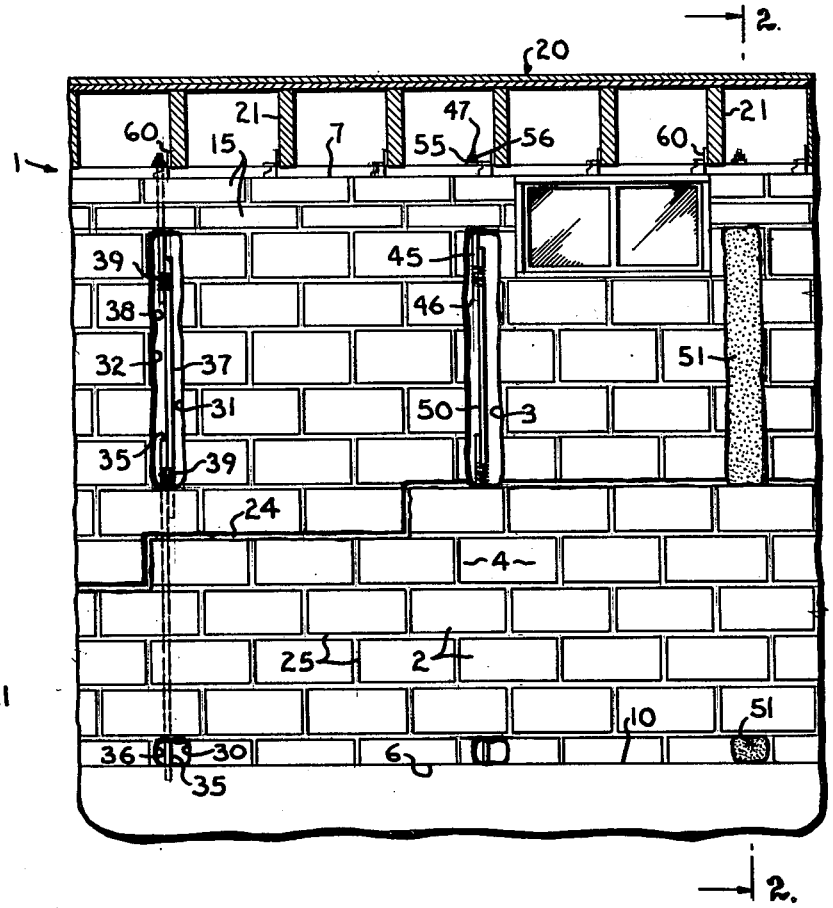
Fig. 2.
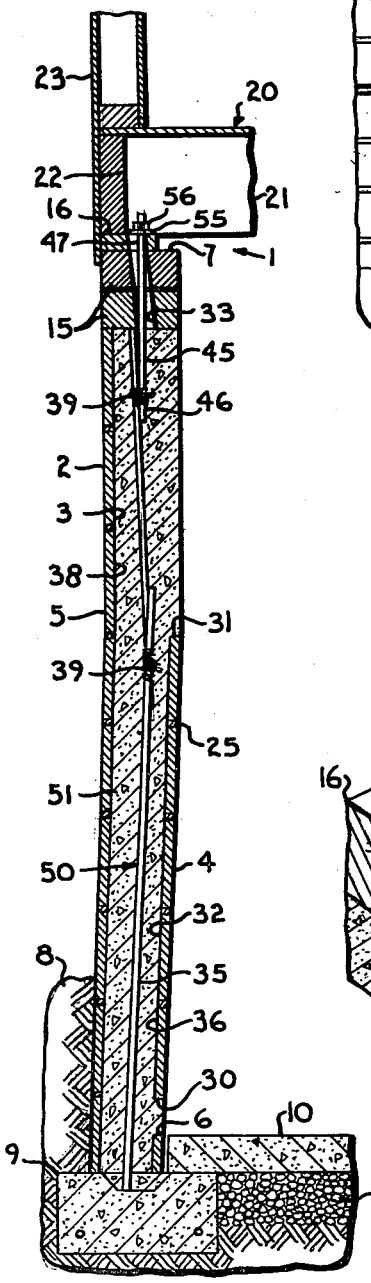
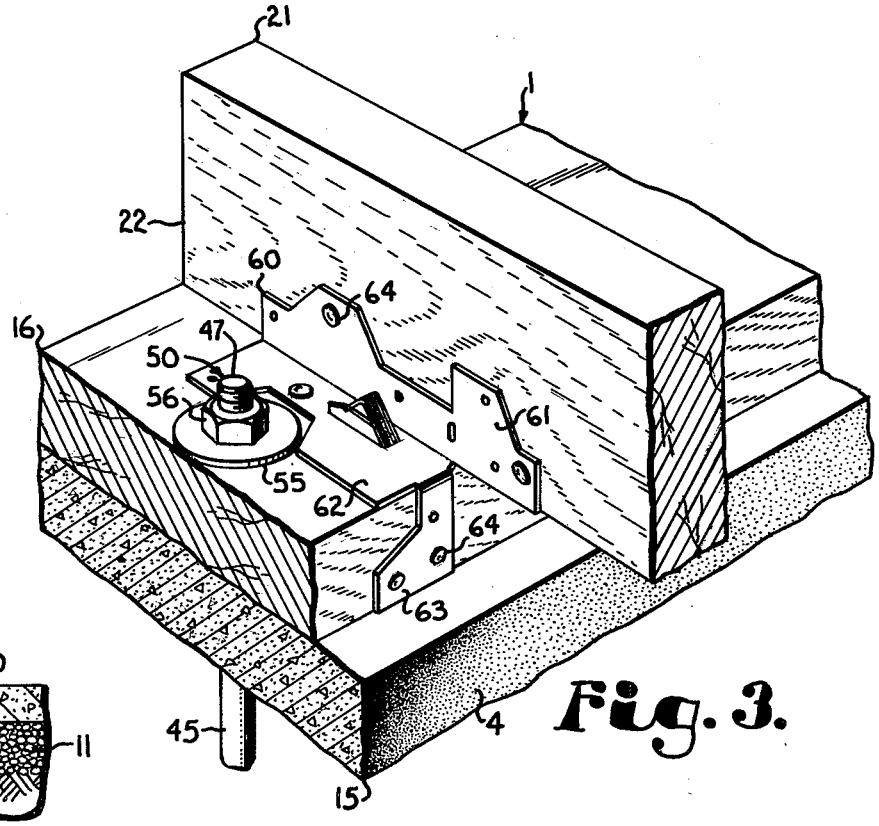
Fig. 3.

STRUCTURE AND METHOD FOR REINFORCING A WALL

CROSS-REFERENCE TO RELATED APPLICATION

This application is a continuation-in-part of application Ser. No. 188,936, filed Sept. 19, 1980 now U.S. Pat. No. 4,353,194 for METHOD OF REPAIRING CONCRETE BLOCK WALLS.

BACKGROUND OF THE INVENTION

1. Field of the Invention

This invention relates to reinforcement structures and methods, and in particular to a reinforcement structure and method for a subterranean masonry block wall.

2. Description of the Prior Art

Walls constructed of masonary blocks are well known in the field of construction and have been extensively used for both above ground and subterranean walls. Such masonary block construction offers the advantage of being relatively inexpensive and walls constructed in this manner are generally capable of supporting residential and light commercial structures thereon.

The blocks generally have two or more passages extending therethrough and, when a wall is constructed, the respective passages of blocks superposed on each other are generally aligned vertically. Although it is known to secure steel reinforcing bars in such aligned passages when a wall is constructed, this practice is frequently omitted as a cost expedient. Therefore, many structures in existence today have subterranean walls comprising unreinforced masonry blocks. Also, building codes in some jurisdictions still allow the construction of such unreinforced subterranean masonry block walls, rather than requiring that such walls be constructed of poured concrete, which is inherently stronger and more resistant to lateral loads associated with, for example, the soil surrounding such subterranean walls.

Although such masonry block walls may have sufficient strength to support structures placed thereon and to carry the downward forces associated therewith, they are inherently weak in lateral loads. Unreinforced subterranean masonry walls are therefore particularly susceptible to cracking from the pressures associated with the surrounding soil. Such pressure may be caused by a horizontal force component associated with the weight of the surrounding soil. Also, such lateral forces may be caused by expansion of the surrounding soil. Partially saturated soil is known to expand when the moisture content thereof is raised. Such expansion occurs in various amounts depending upon the elasticity of the particular soil. When drought conditions occur, soil shrinkage causes surface cracks which allow deep penetration of subsequent precipitation. Water penetrating deeply into soil adjacent a subterranean wall causes substantial lateral movement of the expanding soil against the wall.

Over a period of time, unreinforced masonry block subterranean walls frequently develop diagonal cracks at the ends thereof and vertical cracks near their centers. Such cracks can admit water under pressure from the surrounding soil and, if left untreated, can progressively widen and eventually precipitate the collapse of the entire foundation with resultant damage to the structure supported thereon. In addition to developing such cracks, subterranean unreinforced masonry walls typically either bow inwardly or, if not sufficiently attached to an overlying floor structure, pull inwardly therefrom and tilt. As such bowing or tilting steadily worsens with cycles of drought and precipitation, the weight of the overlying structure tends to exert ever increasing buckling forces against such a wall.

This inherent weakness of unreinforced masonry block walls when subjected to lateral pressure, is attributable to the structural characteristics of the masonry blocks themselves and the mortar joints at which they are connected. Walls constructed in this manner are relatively strong in compression and are thus well suited for supporting overlying structures thereon. However, the mortar joints are weak in tension, and when adjacent blocks are subjected to a tensile force, they tend to separate relatively easily. Lateral forces resulting from, for example, the expansion of surrounding soil, exert a bending moment against the wall which includes a compressive force component at the outer face and a tensile force component at the inner face. Basement wall cracks therefore tend to develop on the insides of such walls as they are either bowed or tilted inwardly.

One method of dealing with such cracked and deformed subterranean walls is shown in the Hevner U.S. Pat. No. 377,940 wherein jacks are utilized for straightening a wall and wedges are placed in buckled portions of the wall to redistribute the compressive forces thereat. Another method for dealing with cracks in masonry walls is shown in the Walter U.S. Pat. No. 2,417,026 and involves the placement of a yieldable and expandable filling material in the cracks. Although such filling material may deter the admission of water therethrough, the individual masonry units are not bound together thereby sufficiently to resist additional separation.

The Johnson et al U.S. Pat. No. 4,189,891 discloses a method for anchoring and straightening subterranean walls including the steps of digging a hole in the earth a distance from the wall to be repaired, inserting a threaded shaft through the wall and the surrounding earth and into the hole where it is secured with concrete. The threaded shaft is tightened by means of a nut positioned inside the basement wall and engaging a plate thereat whereby the wall is drawn outwardly to a straightened position and anchored.

Yet another method involves the placement of steel reinforcing columns against the inside face of the basement wall. Finally, the overlying structure may be supported on jacks while the surrounding earth is excavated and the cracked and deformed basement wall removed and replaced, although this method frequently necessitates the destruction of landscaping adjacent the structure.

Such prior art methods and structures for reinforcing subterranean masonry walls have typically been relatively complex to construct or use, necessitating a relatively high cost to execute, or have been relatively ineffective at sufficiently strengthening such walls to effectively resist the lateral loads exerted thereagainst by the surrounding soil.

SUMMARY OF THE INVENTION

In the practice of the present invention, a structure and method are provided for reinforcing a wall including a plurality of masonry blocks having vertically aligned passages therethrough and sill plates positioned on top of the blocks. A roof or a floor structure is supported on the wall and includes rafters or joists. An opening is formed through one of the blocks and into the aligned passages and lower and intermediate reinforcing bars are inserted therethrough and into a lower portion of the aligned passages. An aperture is formed in the sill plate above the aligned passages and an upper reinforcing bar is inserted through the opening and extends through the aperture and is positioned partly in the aligned passages. The reinforcing bars are connected thereby forming an elongate reinforcing member and the aligned passages are filled with a cementous material which cures to a hardened state. The upper reinforcing bar includes a threaded section which threadably receives a nut engaging the sill plate whereby the reinforcing member may be post tensioned. The rafters or joists are fixedly attached to the sill plate by mechanical framing anchors.

The reinforcing member, in conjunction with the masonry blocks to which it is attached, effectively resists lateral forces exerted against the wall by the surrounding soil. Also, the overlying roof or floor structure is fixedly attached to the masonry block wall and functions to prevent the strengthened and reinforced masonry block wall from moving laterally with respect thereto and tilting inwardly. Economy in construction is achieved because the method may be performed inside the structure and requires a minimum of labor and materials.

The principal objects of the present invention are: to provide an improved method of reinforcing a masonry block wall; to provide such a method wherein a reinforcing member is placed within aligned passages of the masonry blocks; to provide such a method wherein an overlying roof or floor structure is attached to the wall; to provide such a method wherein the reinforcing member includes a threaded portion extending through a sill plate and threadably receiving a nut; to provide such a method which may be performed entirely from the inside of a basement; to provide such a methon which requires relatively little skill or training to perform; to provide such a method which utilizes readily available construction materials; to provide a structure for reinforcing a masonry block which effectively resists lateral forces associated with soil adjacent the wall; to provide such a structure utilizing a reinforcing member inherently strong in tension; to provide such a structure which is primarily contained within the aligned passages through the masonry blocks; to provide such a method and structure which does not require excavation of earth adjacent the wall to be reinforced; and to provide such a method and structure which is economical, efficient in operation, capable of a long operating life, and particularly well adapted for the proposed use.

Other objects and advantages of this invention will become apparent from the following description taken in connection with the accompanying drawings wherein are set forth, by way of illustration and example, certain embodiments of this invention.

BRIEF DESCRIPTION OF THE DRAWINGS

FIG. 1 is a side elevational view of a basement wall reinforced by the method of the present invention and showing reinforcing members positioned in aligned passages of masonry blocks.

FIG. 2 is a vertical cross-sectional view of the basement wall taken generally along line 2—2 in FIG. 1.

FIG. 3 is an enlarged, perspective view of the reinforced wall, particularly showing a framing anchor for attaching a joist to a sill plate and an upper reinforcing bar.

DESCRIPTION OF THE PREFERRED EMBODIMENT

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

For purposes of description herein, the terms "upper", "lower", "vertical", "horizontal", and derivatives thereof shall relate to the invention as oriented in FIG. 1. However, it is to be understood that the invention may assume various alternative orientations, except where expressly specified to the contrary.

Referring the drawings in more detail, the reference numeral 1 generally designates a basement wall reinforced according to the method of the present invention and comprising a plurality of masonry blocks, such as concrete blocks 2 having vertically aligned passages 3 therethrough. The basement wall 1 displays inner and outer faces 4 and 5 respectively, a bottom 6 and a top 7. The basement wall outer face 5 engages an earth mass 8 which exerts a lateral force against the basement wall 1.

The basement wall 1 is supported by a concrete footing 9 and a concrete basement floor slab 10 extends horizontally from the bottom 6 thereof. The floor slab 10 is supported on a gravel bed 11 which facilitates the drainage and removal of water from thereunder.

The basement wall 1 includes two staggered and superposed courses of cap blocks 15 comprising solid concrete and positioned at the basement wall top 7. A structural member comprising a sill plate 16 is placed on the uppermost course of cap blocks 15 and extends longitudinally of the basement wall 1 substantially flush with its outer face 5. The courses of cap blocks 15 are frequently omitted in the construction of basement walls wherein a sill plate rests directly on a top course of concrete blocks.

The basement wall 1 of the illustrated embodiment supports a floor structure 20 thereon including a plurality of spaced, parallel, horizontally extending structural members such as joists 21 each supported at an end 22 thereof on the sill plate 16. The floor structure 20 in turn supports an exterior wall structure 23. The basement wall 1 as shown is bowed inwardly and displays a crack 24 at mortar joints 25 where adjacent masonry blocks 2 have separated.

In reinforcing the basement wall 1 with the method and structure of the present invention, a lower opening 30 is formed by removing portions adjacent the wall inner face 4 of a concrete block 2 positioned at the wall bottom 6. An elongated upper opening 31 is formed by removing portions adjacent the wall inner face 4 of respective masonry blocks 2. The upper opening 31 terminates in spaced relation below the basement wall top 6 and in spaced relation above the lower opening 30. Each vertically aligned pair of lower and upper openings 30 and 31 respectively open into a respective vertically aligned column 32 of passages 3. When the upper opening 31 is formed, portions of the respective blocks 2 and other debris knocked into a respective column 32 of vertically aligned passages 3 is removed through the lower opening 30.

With the respective vertically aligned passage columns 32 thus opened, an aperture 33 is formed through the cap blocks 15 and the sill plate 16 above and aligned with the respective passage columns 32. The aperture 33 may be formed by using a drill positioned adjacent the basement wall inner face with a relatively long bit extending upwardly through the upper opening 31 and drilling through the cap blocks 15 and the sill plate 16. Alternatively, a drill and bit interconnected by an angle drive may be utilized for drilling the apertures 33 upwardly from respective passage columns 32.

A lower reinforcing bar 35 is then inserted through the upper opening 31 and positioned in a lower portion 36 of each respective column 32 of vertically aligned passages 3. The lower reinforcing bar 35 engages and is supported on the basement wall footing 9 and terminates slightly above the lowermost level of the upper opening 31, as shown in FIG. 2. An intermediate reinforcing bar 37 is then inserted into a column upper portion 38 of a respective column 32 of aligned passages 3 and is secured to the lower reinforcing bar 35 thereby a tie wire 39. An upper reinforcing bar 45 is inserted through each respective upper opening 31 and includes a lower section 46 extending downwardly into the passage column upper portion 38 and an upper section 47 extending through the sill plate 16 and terminating thereabove. The upper reinforcing bar 45 is connected at its lower section 46 to the intermediate reinforcing bar 37 by a tie wire 39.

Each respective lower, intermediate and upper reinforcing bar 35, 37 and 45 form a respective elongate reinforcing member 50 positioned within a respective column 32 of vertically aligned passages 3. The lower and intermediate reinforcing bars 35 and 37 respectively may comprise, for example, steel reinforcing bars of the type generally used in reinforced concrete construction. The upper reinforcing bars 45 may comprise, for example, steel rods, at least the upper sections 46 of which are threaded.

With the reinforcing members 50 positioned in respective aligned passage columns 32, the columns 32 are filled with a cementous material 51 which cures to a hardened state whereby the reinforcing members 50 are securely attached to respective masonry blocks 32 within their respective aligned passage columns 32. After the cementous material 51 cures to its hardened state, the reinforcing members 50 may be post tensioned by placing washers 55 over the upper reinforcing bar upper sections 47, threadably engaging nuts 56 thereon, and tightening the nuts 56 whereby the reinforcing members are placed in tension.

The floor joists 21 adjacent each reinforced passage column 32 are fixedly attached to the sill plate 16 and thus to the basement wall 1 by respective framing anchor 60. As shown in FIG. 3, the framing anchors 60 are of conventional construction including a side plate 61 engaging the joists 2 and horizontal and front plates 62 and 63 respectively engaging the sill plate 16. The framing anchors 60 are attached to the sill plate 16 and respective joists 21 by suitable mechanical fastener, such as nails 64.

The reinforcement method of the present invention produces a resulting reinforcement structure whereby the basement wall 1 is reinforced to effectively resist the lateral forces associated with the surrounding earth mass 8 and is fixedly attached to the overlying floor structure 20 to prevent the reinforced and strengthened basement wall 1 from moving laterally with respect thereto. The basement wall 1 thus functions in cooperation with the floor structure 20 to effectively resist the lateral forces associated with the adjacent earth mass 8. Such lateral forces exert a bending moment against the basement wall 1, thereby placing portions of the masonry blocks 2 adjacent its outer face 5 in compression and exerting a tensile force component which is carried by the reinforcing members 50.

By way of example, the structural components of the reinforced basement wall 1 may have the following characteristics. The distance between the floor slab 10 and the bottom of the floor structure 20 is approximately 8 feet. The concrete blocks are each approximately 7½ inches deep (8 inches nominal thickness) whereby the basement wall 1 is approximately 7½ inches thick between its inner and outer faces 4 and 5 respectively. The reinforcing bars 35 and 37 are of a size generally designated number 5 with a yield strength of 60,000 lbs. per square inch. The reinforcing members 50 are placed in aligned passage columns 32 occuring at approximately 4 foot intervals along the basement wall 1. The upper reinforcing bars 45 comprise ⅝ inch diameter threaded steel rods. The cementous material 51 filling the passage columns 32 has a yeild strength of approximately 3,000 lbs. per square inch. Utilizing the aforementioned specifications for the respective materials, the basement wall 1 is calculated as capable of retaining the earth mass 8 as having an equivalent fluid pressure of 30 lbs. per cubic foot. The basement wall 1 thus reinforced will effectively retain the adjacent earth mass 8 through expansion and contraction cycles associated with varying conditions of moisture content.

Although a basement wall 1 supporting a floor structure 20 with structural members comprising joists 21 as shown, the method and apparatus of the present invention may be utilized for other masonry block walls, for example, an above-grade wall supporting a roof structure with structural members comprising joists.

It is to be understood that while certain embodiments of the present invention have been illustrated and described herein, it is not to be limited to the specific forms or arrangement of parts herein described and shown.

What is claimed and desired to secure by Letters Patent is:

1. A method of reinforcing an existing wall having a face and a structural member positioned on top thereof, said wall comprising a plurality of blocks with vertically aligned passages, which includes the steps of:

(a) forming an opening in a plurality of said blocks at said wall face into a respective plurality of said aligned passages;

(b) placing a lower reinforcing bar through said opening and in a lower portion of said aligned passages;

(c) placing an upper reinforcing bar through said opening and in an upper portion of said aligned passages;

(d) attaching said upper reinforcing bar to said structural member;

(e) connecting said lower and upper reinforcing bars; and (f) placing a material which cures to a hardened state in said passages whereby said reinforcing bars are fixedly secured to said wall within said passages.

2. The method as set forth in claim 1 including the steps of:
(a) forming an opening in said structural member; and
(b) extending said upper reinforcing bar through said opening.

3. The method as set forth in claim 1 wherein said upper reinforcing bar includes a threaded portion, including the steps of:
(a) placing a nut on said upper reinforcing bar threaded portion; and
(b) tightening said nut with respect to said threaded portion whereby said reinforcing member is placed in tension.

4. The method as set forth in claim 1 wherein said material comprises a cementous material, including the step of:
(a) curing said cementous material to its hardened state.

5. The method as set forth in claim 1 wherein said structural member comprises a sill plate with a joist or a rafter extending therefrom, including the step of:
(a) attaching an anchor to and thereby connecting said sill plate and said joist or rafter.

6. The method as set forth in claim 1 including the steps of:
(a) placing an intermediate reinforcing bar in said aligned passages;
(b) connecting said intermediate reinforcing bar to said lower reinforcing bar; and
(c) connecting said intermediate reinforcing bar to said upper reinforcing bar.

7. The method as set forth in claim 5 wherein said upper reinforcing bar includes a threaded portion, including the steps of:
(a) forming an opening in said sill plate;
(b) extending said upper reinforcing bar through said opening;
(c) placing a nut on said threaded portion; and
(d) tightening said nut against said sill plate.

8. A method of reinforcing an existing wall including a face and comprising a plurality of blocks with vertically aligned passages, said wall having a sill plate positioned on top thereof and a joist or rafter extending from said plate which includes the steps of:
(a) forming a lower opening at said wall face and adjacent a bottom of said wall into said aligned passages;
(b) forming an upper opening in a plurality of said blocks at said wall face into a respective plurality of said aligned passages in spaced relation above said lower opening;
(c) forming an aperture in said sill plate;
(d) placing a lower reinforcing bar through said upper opening and in a lower portion of said aligned passages;
(e) placing an intermediate reinforcing bar through said upper opening and in an upper portion of said aligned passages;
(f) placing an upper reinforcing bar having a threaded portion through said upper opening and in said upper portion of said aligned passages and through said sill plate aperture;
(g) connecting said lower and said intermediate reinforcing bar;
(h) connecting said intermediate and said upper reinforcing bars and thereby forming an elongate reinforcing member;
(i) placing a cementous material in said aligned passages;
(j) curing said cementous material to a hardened state whereby said reinforcing member is fixedly attached to said wall within said aligned passages;
(k) threadably engaging a nut on said reinforcing bar threaded portion;
(l) tightening said nut against said sill plate; and
(m) attaching a mechanical anchor to said sill plate and said joist or rafter.

9. The method as set forth in claim 8 including the step of:
(a) tightening said nut after said cementous material has cured whereby said reinforcing member is post tensioned.

* * * * *